US005207323A

United States Patent [19]

McConnell

[11] Patent Number: 5,207,323

[45] Date of Patent: May 4, 1993

[54] SKI SOCK

[76] Inventor: Hardison G. McConnell, 3841 Sandlewood Rd., High Point, N.C. 27625

[21] Appl. No.: 763,429

[22] Filed: Sep. 20, 1991

[51] Int. Cl.[5] ..... A63G 11/00; B65D 85/20

[52] U.S. Cl. ..... 206/315.1; 280/814; 150/154

[58] Field of Search ..... 206/315.1; 280/814, 280/815; 150/154

[56] References Cited

U.S. PATENT DOCUMENTS

| | | | |
|---|---|---|---|
| 3,336,961 | 8/1967 | Welsh | 206/315.1 |
| 4,191,233 | 3/1980 | McKay | 206/315.1 |
| 4,319,617 | 3/1982 | Fusaro | 206/315.1 |
| 4,402,355 | 9/1983 | Wymore et al. | 206/315.1 |
| 4,644,986 | 2/1987 | Fusaro | 206/315.1 |
| 4,715,416 | 12/1987 | Horne | 206/315.1 X |
| 5,012,921 | 5/1991 | Becker | 206/315.1 |
| 5,022,678 | 6/1991 | Mayfield | 150/154 X |

*Primary Examiner*—William I. Price

*Attorney, Agent, or Firm*—Rhodes Coates & Bennett

[57] ABSTRACT

The present invention is a ski sock for protecting snow skis. The ski sock generally comprises a fabric tube constructed of absorbent and elastic materials. The sock is closed and V-shaped at one end to better fit the forward end of a ski. The other end of the sock is opened to receive a ski and has an elastic band thereabout to better retain the ski. The inside of the sock tube is coated with a slick film such as silicon so that a ski may be more easily slipped into and out of the sock. The ski covering of the present invention may be used in conjunction with other ski carrying bags.

7 Claims, 3 Drawing Sheets

SKI SOCK

FIELD OF THE INVENTION

The present invention relates to ski equipment more particularly to a sock type cover for storing and protecting skis.

BACKGROUND OF THE INVENTION

Modern snow ski are highly sophisticated sporting equipment. Snow skis require a substantial initial investment and are relatively expensive to maintain properly. The quality and fine tuning of a skiers skis have a substantial impact on his performance on the slopes, whether he be an amateur or a professional. For this reason, a great deal of equipment and techniques have been developed for maintaining, storing, and carrying snow skis.

Of particular importance are the skis' edges. Dulled ski edges significantly reduce a skiers ability to carve the snow. Serious skiers spend many hours honing their skis' edges to gain an extra advantage on the slopes.

While normal use tends to dull the edges, this wear is greatly accelerated by impacts occurring during storage and transport of the skis. Most of these impacts are between the skis themselves. Ski bags are in common use and examples are found in U.S. Pat. Nos. 3,336,961; 5,012,921; and 4,715,416. Such bags are essentially designed for carrying and convenience and to protect against the skis damaging other objects. Most ski bags do not, however, protect the skis from damaging each other. No known ski bag adequately protects skis from one another. Therefore, there exists a need to provide a protective covering for individual skis which will protect them from their mated skis. Ideally, such a covering would be useable in conjunction with existing ski carry bags.

The skis storage environment is also important. Skis used in snow become wet which, if not dried, causes them to rust. Therefore, there exists a need for a convenient and inexpensive means for keeping snow skis dry in storage.

SUMMARY OF THE INVENTION

The present invention entails a ski sock that is inexpensive and convenient to use and which protects skis from damage, particularly damage from other skis. Additionally, the ski sock of the present invention provides a suitable environment for storage and may be used in conjunction with existing ski carrying bags.

The ski sock includes an elongated tube sock body which has a closed, V-shaped tip at one end and an elastic opening on the other end for receiving a ski. The inside of the ski sock is provided with a dry slick coating to make sliding of the ski into and out of the sock easier. The ski sock in constructed from a blend of absorbent and elastic or stretchable materials so that it fits snugly about the ski and keeps it dry for storage.

It is an object of the present invention to provide an easy to use and inexpensive cover for protecting and storing skis.

It is another object of the present invention to provide a cover which absorbs moisture from skis and keeps them dry.

It is an object of the present invention to provide a cover that will protect skis from contact with other objects including mated skis.

It is also an object of the present invention to provide a sock type cover of the character referred to above which may be used in conjunction with existing ski carrying bags.

Other objects and advantages of the present invention will become apparent and obvious from a study of the following description and the accompanying drawings which are merely illustrative of such invention.

DETAILED DESCRIPTION OF THE DRAWINGS

Figure 1:
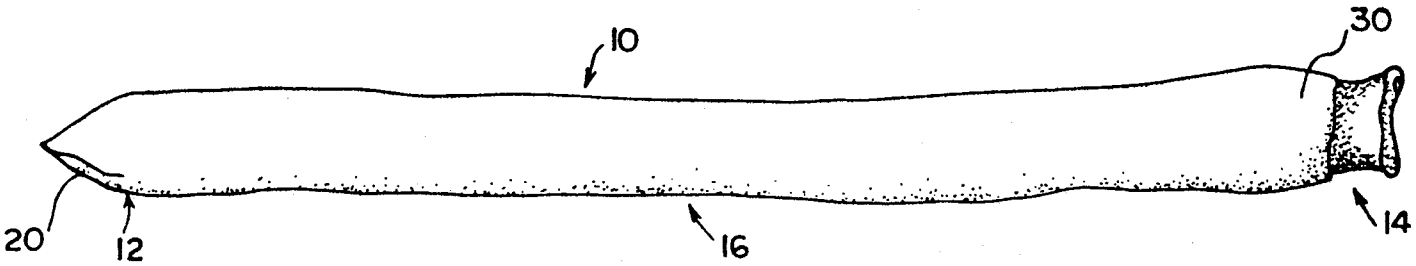
FIG. 1 is a perspective view of the ski sock of the present invention.
Figure 3:
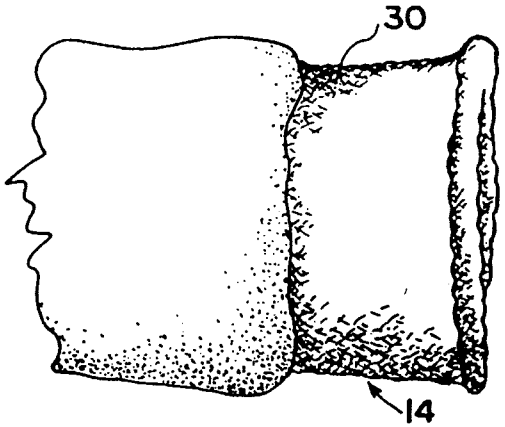
FIG. 3 is a fragmentary perspective view of the inlet end of the ski sock.
Figure 2:
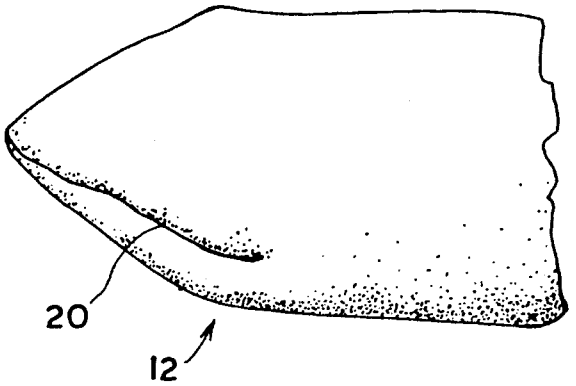
FIG. 2 is a fragmentary perspective view of the closed end of the ski sock.
Figure 4:
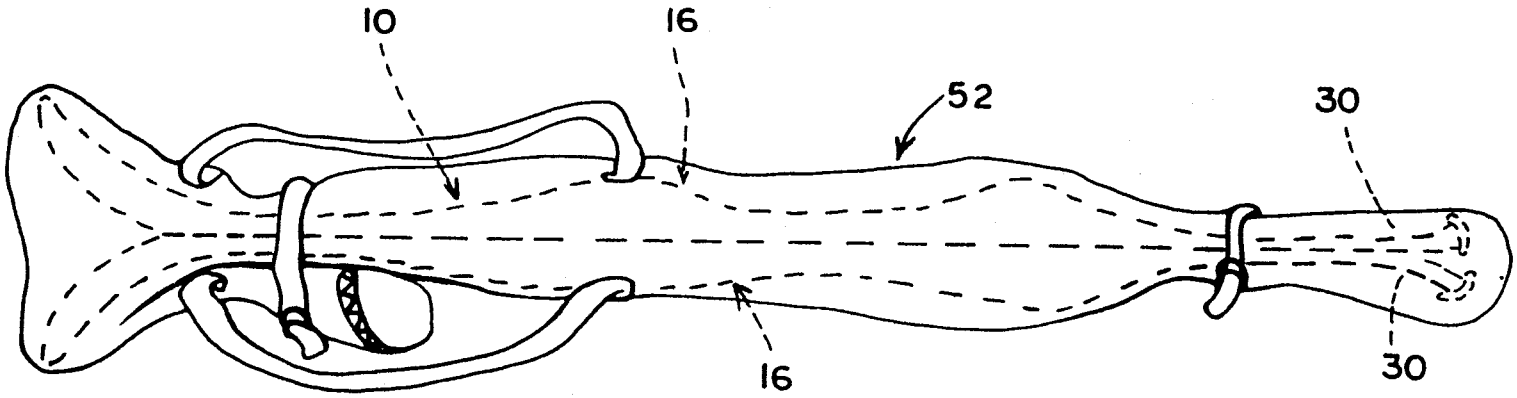
FIG. 4 is a top plan view of a pair of skis covered by ski socks of the present invention and disposed within a ski carrying bag.
Figure 5:
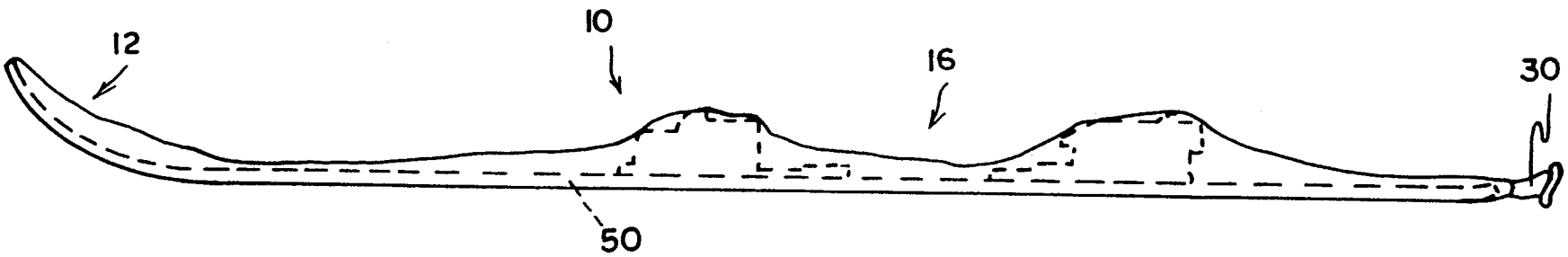
FIG. 5 is a side elevational view of a ski disposed within the ski sock of the present invention with the ski shown in dotted lines.
Figure 6:
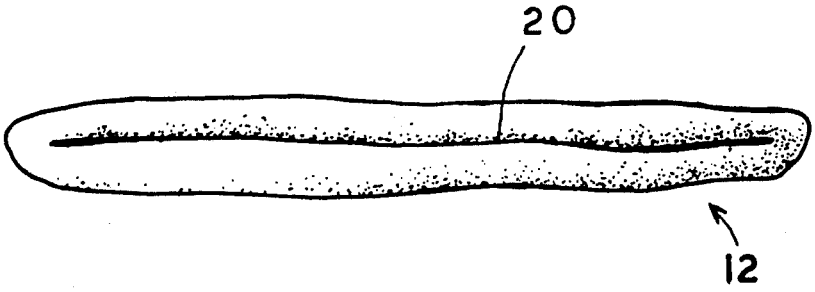
FIG. 6 is an end elevational view of the closed end of the ski sock of the present invention.

Referring now to the drawings, the ski sock of the present invention is shown therein and indicated generally by the numeral 10. Ski sock 10 comprises elongated main body 16, closed end 12, and inlet end 14. Ski sock 10 is adapted for use with a ski 50 and may be used in conjunction with a typical ski carrying bag 52.

Sock 10 is constructed from a blend of absorbent and elastic materials and may be made in a conventional fashion. In the preferred embodiment, the sock 10 is formed of an 80% cotton and 20% nylon interwoven blend. Typically, the sock 10 is made with a needle count of 108 and has a weight in the range of 70–100 double. A gauge in the range of 10–18 single is thought to be preferred. Sock 10 is sized such that in its relaxed state its diameter is somewhat smaller than ski 50 while its length is approximately the same as ski 50. With these dimensions, ski sock 10 fits snugly about and completely covers ski 50. In the preferred embodiment, ski sock 10 has an average side stretch of 8 to 10 inches. The interior surface of the sock 10 is coated with a dry, slick film such as a silicon film. This film facilitates insertion and removal of ski 50 from ski sock 10 without making ski 50 oily or wet.

Closed end 12 is formed in a V-shape on one end of sock 10 by v-shaped side seams 20. Closed end 12 retains and form-fits the forward tip of ski 50.

Inlet end 14 is formed on the end of sock 10 opposite closed end 12 and includes elastic band 30. Elastic band 30 is adapted to receive ski 50 in its expanded state and retain the same in its relaxed state.

To use ski sock 10, ski 50 is inserted tip end first through elastic band 30 and main body 16 until it engages the V-shaped closed end 12. It is appreciated that because of the slick film interior coating, ski 50 is relatively easy to insert. Once ski 50 is fully inserted, elastic band 30 contracts to hold ski 50 inside ski sock 10. Due to the size, shape and material of ski sock 10, ski 50 is held snugly and completely covered, and any moisture on the ski is wicked away.

Ski sock 10 only negligibly increases the size of ski 50. Therefore, ski 50 covered by ski sock 10 may be inserted into a typical ski carrying bag 52 in the same manner as an uncovered ski 50 would be inserted into the bag. Therefore, it is appreciated that the skis 50 do not bump against each other while covered with the ski sock 10. Consequently, the skis 50 are protected against scratching and the edges of the skis remain shape and fit for championship competition.

Ski sock 10 is also ideal for storing ski 50. The cotton and nylon blend of materials provides ventilation to ski 50 while at the same time it wicks moisture from the same. This combination of effects prevents rust and mildew and maintains the ski 50 in a ready state.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

I claim:

1. A ski sock snugly covering and protecting a ski having a curved tip end, a main portion, and a trailing end portion, comprising:

(a) ski sock means for receiving, holding and protecting a ski;

(b) the ski sock means including a sock constructed of a relatively soft, stretchable fabric material that snugly fits around and conforms to the ski;

(c) the sock having interior and exterior surfaces, a ski inlet end, an elongated main body portion, and a V-shaped closed tip end for receiving and conforming to the tip end of the ski; and (d) a silicon film formed about the interior surface of the ski sock to facilitate the insertion and removal of the ski as well as to provide an appropriate environment for protecting the ski during storage.

2. The ski sock according to claim 1 wherein the inlet end includes an elastic open end which may expand to receive a ski and contract to substantially close the inlet end around the ski.

3. The ski sock according to claim 1 wherein the V-shaped closed tip end is formed by two converging side seams.

4. The ski sock according to claim 1 wherein the ski sock is formed of a blend of absorbent and elastic materials.

5. A ski sock for snugly covering and protecting a ski having a curve tip end, a main body portion, and a trailing end portion comprising:

(a) ski sock means for receiving, holding, and protecting a ski;

(b) the ski sock means including a sock constructed of a relatively soft, stretchable fabric material that snugly fits around and conforms to the ski;

(c) the ski sock having a ski inlet end, an elongated main body portion, and a closed tip end for receiving the tip end of the ski; and (d) the ski sock further including interior and exterior surfaces and wherein the interior surface is provided with a relatively slick film that facilitates insertion and removal of the ski and provides an environment for protecting the ski during storage.

6. The ski sock according to claim 5 wherein the closed tip end is V-shaped for conforming to the tip end of the ski.

7. The ski sock according to claim 5 wherein the ski inlet end includes an elastic open end which may expand to receive a ski and contract to substantially close the inlet end portion around the ski.

* * * * *